US008459479B2

(12) United States Patent
Yourist

(10) Patent No.: US 8,459,479 B2
(45) Date of Patent: Jun. 11, 2013

(54) PLASTIC CONTAINER HAVING ENHANCED CRUSH RESISTANCE AND POURING STABILITY

(75) Inventor: Sheldon E. Yourist, York, PA (US)

(73) Assignee: Graham Packaging Company, L.P., York, PA (US)

( * ) Notice: Subject to any disclaimer, the term of this patent is extended or adjusted under 35 U.S.C. 154(b) by 894 days.

(21) Appl. No.: 12/047,695

(22) Filed: Mar. 13, 2008

(65) Prior Publication Data

US 2009/0230084 A1 Sep. 17, 2009

(51) Int. Cl.
*B65D 90/02* (2006.01)

(52) U.S. Cl.
USPC ..... 215/384; 215/382; 215/398; 220/771; 220/755

(58) Field of Classification Search
USPC ..... 215/398, 382, 384, 396; 220/771, 220/755, 756, 767
See application file for complete search history.

(56) References Cited

U.S. PATENT DOCUMENTS

| | | | | | |
|---|---|---|---|---|---|
| 3,232,495 | A | * | 2/1966 | Schueider | 222/209 |
| D210,113 | S | * | 2/1968 | Gantz et al. | D9/528 |
| 3,892,828 | A | * | 7/1975 | Weatherly et al. | 264/515 |
| D259,405 | S | * | 6/1981 | Drummond | D9/528 |
| D314,140 | S | * | 1/1991 | Kornick et al. | D9/528 |
| 5,366,101 | A | * | 11/1994 | Krall et al. | 215/398 |
| 5,392,937 | A | | 2/1995 | Prevot et al. | |
| 5,472,105 | A | * | 12/1995 | Krishnakumar et al. | 215/384 |
| D423,936 | S | * | 5/2000 | Smith et al. | D9/520 |
| D424,946 | S | * | 5/2000 | Alsup | D9/528 |
| D437,774 | S | | 2/2001 | Piccioli et al. | |
| D440,159 | S | * | 4/2001 | Guislain | D9/543 |
| D444,710 | S | | 7/2001 | Zboch et al. | |
| 6,273,282 | B1 | * | 8/2001 | Ogg et al. | 215/381 |
| D451,811 | S | | 12/2001 | Zboch et al. | |
| D459,993 | S | * | 7/2002 | Clarke et al. | D9/528 |
| D463,981 | S | * | 10/2002 | Crawford et al. | D9/530 |
| D473,794 | S | * | 4/2003 | Ouillette et al. | D9/523 |
| D524,660 | S | * | 7/2006 | Floyd et al. | D9/550 |
| 7,080,746 | B2 | | 7/2006 | Saito et al. | |
| D536,255 | S | | 2/2007 | Corbett et al. | |
| D539,155 | S | | 3/2007 | Steinmann | |
| D555,482 | S | * | 11/2007 | Bates et al. | D9/528 |
| D580,268 | S | * | 11/2008 | Roman et al. | D9/516 |
| D642,473 | S | * | 8/2011 | Vanhooland et al. | D9/516 |

* cited by examiner

*Primary Examiner* — Anthony Stashick
*Assistant Examiner* — Christopher McKinley
(74) *Attorney, Agent, or Firm* — The Patentwise Group, LLC

(57) ABSTRACT

A molded plastic container is shaped so as to resist deformation as a result of compressive forces that may be applied by the consumer during use. The container includes a pair of recessed grip portions that are molded into forward and rearward sides of the container and an outer handle portion. Reinforcing ribs are integrally molded into the forward and rearward sidewalls of the container in areas that are substantially adjacent to the recessed grip portions in order to provide additional crush resistance as the container is squeezed. Additionally, a torsional reinforcement rib is integrated into an upper side portion of the container in order to resist deformation of the container and the pouring opening of the container during pouring. The torsional reinforcement rib is integral with the two reinforcing ribs, which provides additional strength and pouring stability to the container.

22 Claims, 7 Drawing Sheets

PLASTIC CONTAINER HAVING ENHANCED CRUSH RESISTANCE AND POURING STABILITY

BACKGROUND OF THE INVENTION

1. Field of the Invention

This invention relates generally to plastic containers, and in particular to molded plastic containers that are used to package beverages and other liquids.

2. Description of the Related Technology

Molded plastic containers for packaging beverages such as orange juice are in wide commercial use throughout the world. Such containers may be fabricated using the extrusion blow molding process, which is typical for containers that are fabricated from a material such as polyolefin, or a stretch blow molding process, which is typical for containers that are fabricated from polyethylene terephthalate, which is commonly known as PET.

When filled with a product, molded plastic containers can be fairly heavy and difficult to handle by some consumers, particularly in the larger sizes. This problem is compounded by any condensation in the form on the exterior surface of the plastic container. Accordingly, it is typical for certain types of plastic containers to be designed with integrated gripping recesses and handles so as to facilitate safety and ease of handling by the consumer.

The configuration of many containers incorporating such gripping recesses and handles is such that a consumer will be induced to grip the container using the forefingers and the thumb in a pinching action that can impart significant compressive forces to the container. While this may facilitate a comfortable and effective manner in which to grip the container from the standpoint of the consumer, the resulting compressive forces, which tend to be concentrated near the recessed grip portions of the container, can result in significant inward deflection and deformation of the container. Such deformation can result in a reduction of the storage volume of the container, causing product to be forced out of the pouring opening of the container in unwanted fashion when the container is full or close to being full. In addition, such deformation can result in a change in the pouring characteristics of the container, either by changing the shape of the dispensing opening itself or the shape of the surfaces that are immediately adjacent to the dispensing opening.

A need exists for an improved plastic container that provides a safe and convenient gripping configuration for the consumer but that exhibits better resistance against deformation than has been the case with conventional designs.

SUMMARY OF THE INVENTION

Accordingly, it is an object of the invention to provide an improved plastic container that provides a safe and convenient gripping configuration for the consumer but that exhibits better resistance against deformation than has been the case with conventional designs.

In order to achieve the above and other objects of the invention, a plastic container that is constructed according to a first aspect of the invention includes an upper portion having an opening defined therein; a bottom portion; and a container body having a side wall, the side wall being configured so as to define an outer handle portion, a main body portion and a recessed grip portion positioned between the main body portion and the outer handle portion, the container body further comprising at least one grip reinforcement rib that is integrated into at least one of the outer handle portion and the main body portion, the at least one grip reinforcement rib providing additional strength against inward compression of the container body as a result of compressive forces that may be applied to the recessed grip portion by a consumer.

According to a second aspect of the invention, a plastic container includes an upper portion having an pouring opening defined therein; a bottom portion; and a container body having a side wall, the side wall defining a forward surface, a rearward surface and first and second side surfaces, the forward and rearward surfaces having opposing grip portions defined therein, and wherein one of the side surfaces comprises an integral torsional reinforcement rib that is integrated into an upper portion of the side surface, the integral torsional reinforcement rib providing torsional reinforcement against inward deflection of the forward surface and the rearward surface as a result of compressive forces that may be applied to the forward and rearward surfaces by a consumer, whereby structural integrity of the container is improved during pouring.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
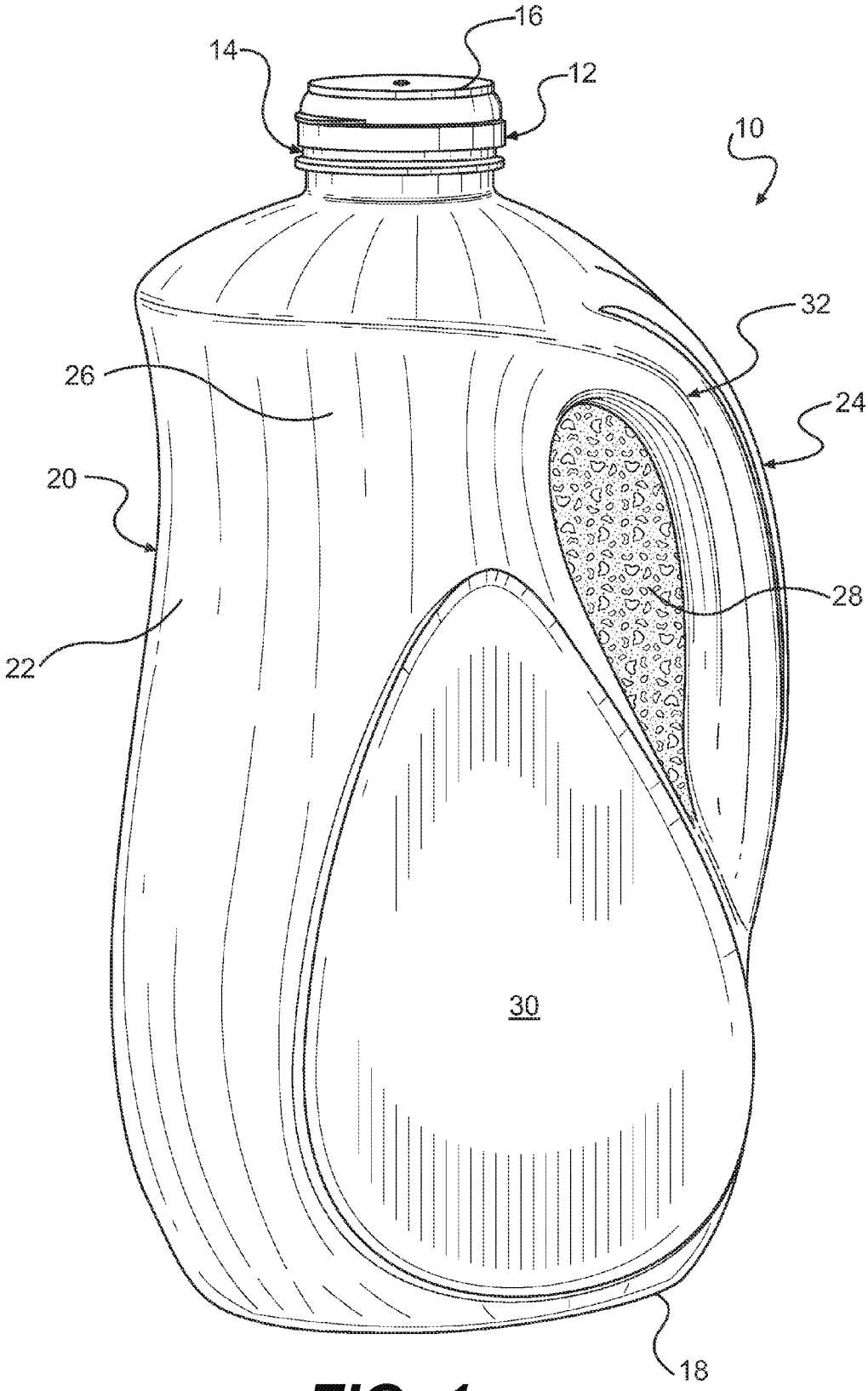
FIG. 1 is a perspective view of a plastic container that is constructed according to a preferred embodiment of the invention.

Referring now to the drawings, wherein like reference numerals designate corresponding structure throughout the views, and referring in particular to FIG. 1, a plastic container 10 that is constructed according to a preferred embodiment of the invention is preferably integrally molded from a plastic material such as polyolefin, polyethylene terephthalate (PET), polyethylene, polypropylene or similar plastic materials. Most preferably, plastic container 10 is manufactured using the extrusion blow molding process at a material that includes polyolefin. Alternatively, however, plastic container 10 could be manufactured out of polyethylene terephthalate using the stretch blow molding process.

Referring first FIG. 1, it will be seen that plastic container 10 includes an upper portion 12 that has a pouring opening defined therein, which in the drawings is obscured by a closure cap 16. Upper portion 12 preferably includes a threaded finish portion 14 onto which the closure cap 16 is fastened.

Figure 2:
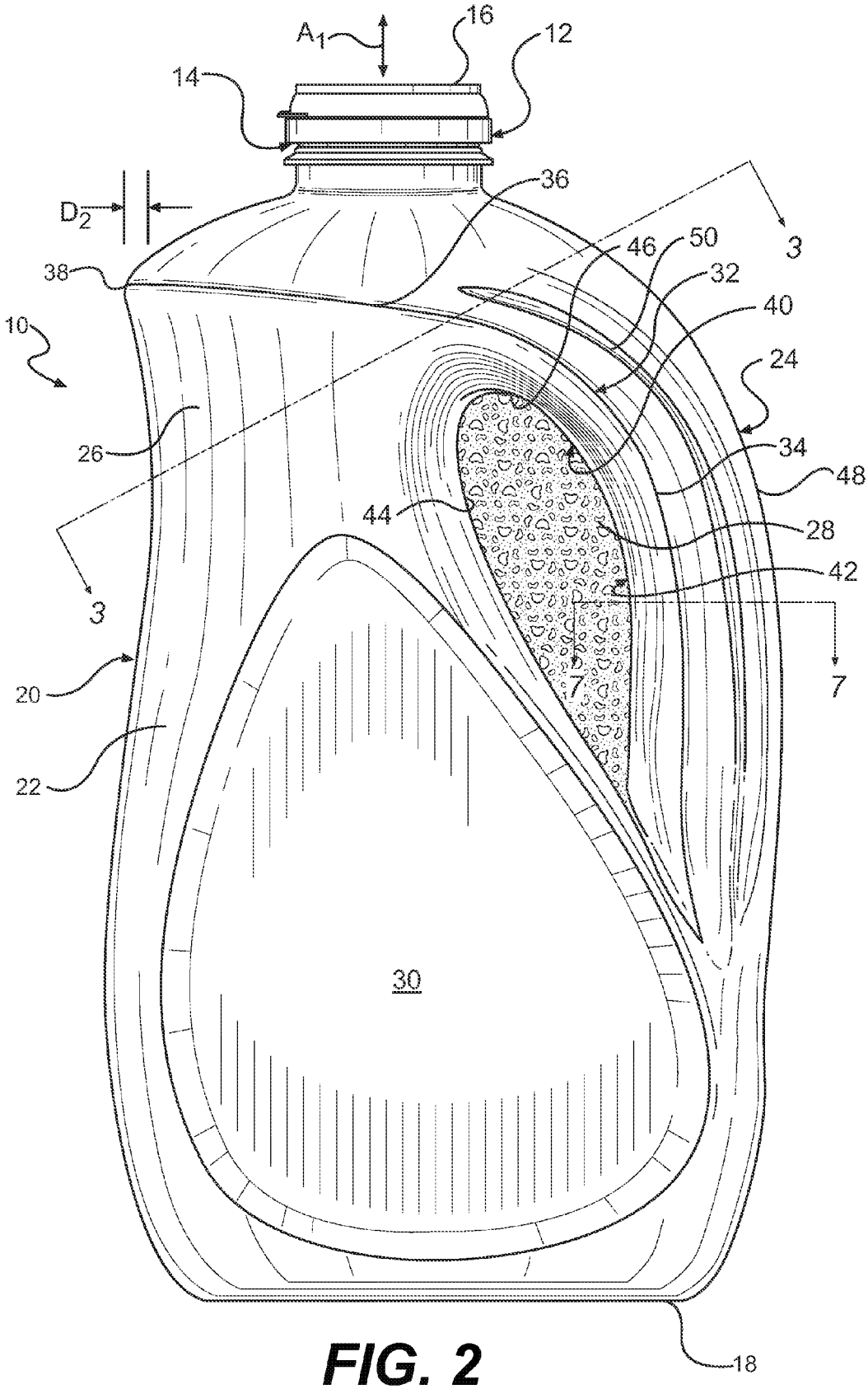
FIG. 2 is a front elevational view of the plastic container that is depicted in FIG. 1.
Figure 3:
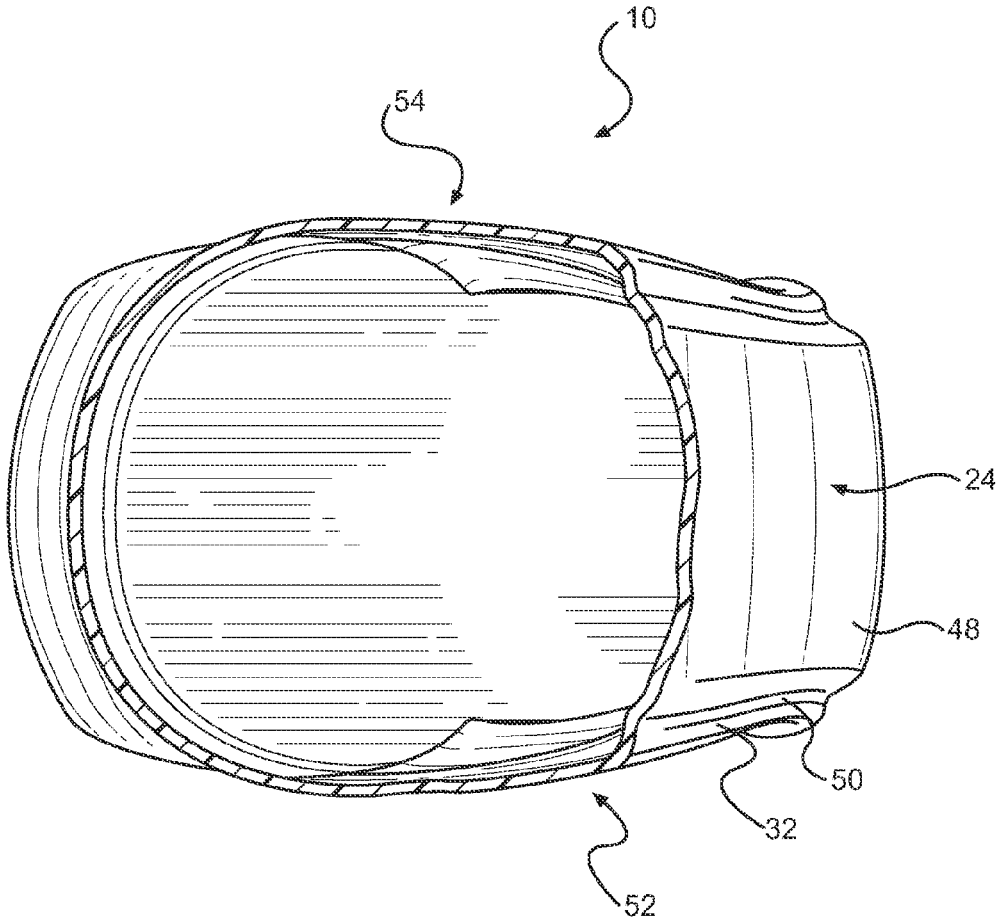
FIG. 3 is a cross-sectional view taken along lines 3-3 in FIG. 2.
Figure 4:
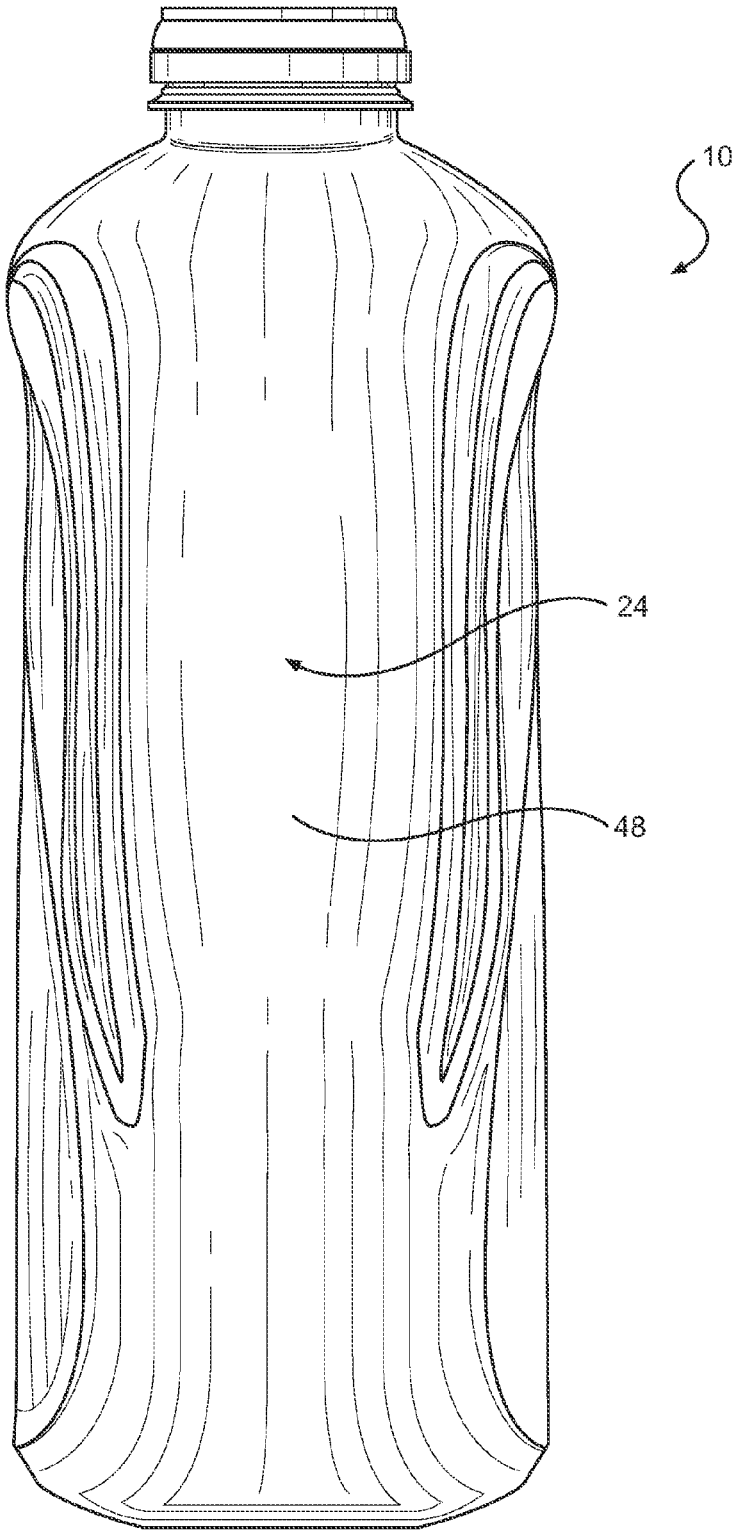
FIG. 4 is a first side elevational view of the plastic container that is depicted in FIG. 1.
Figure 5:
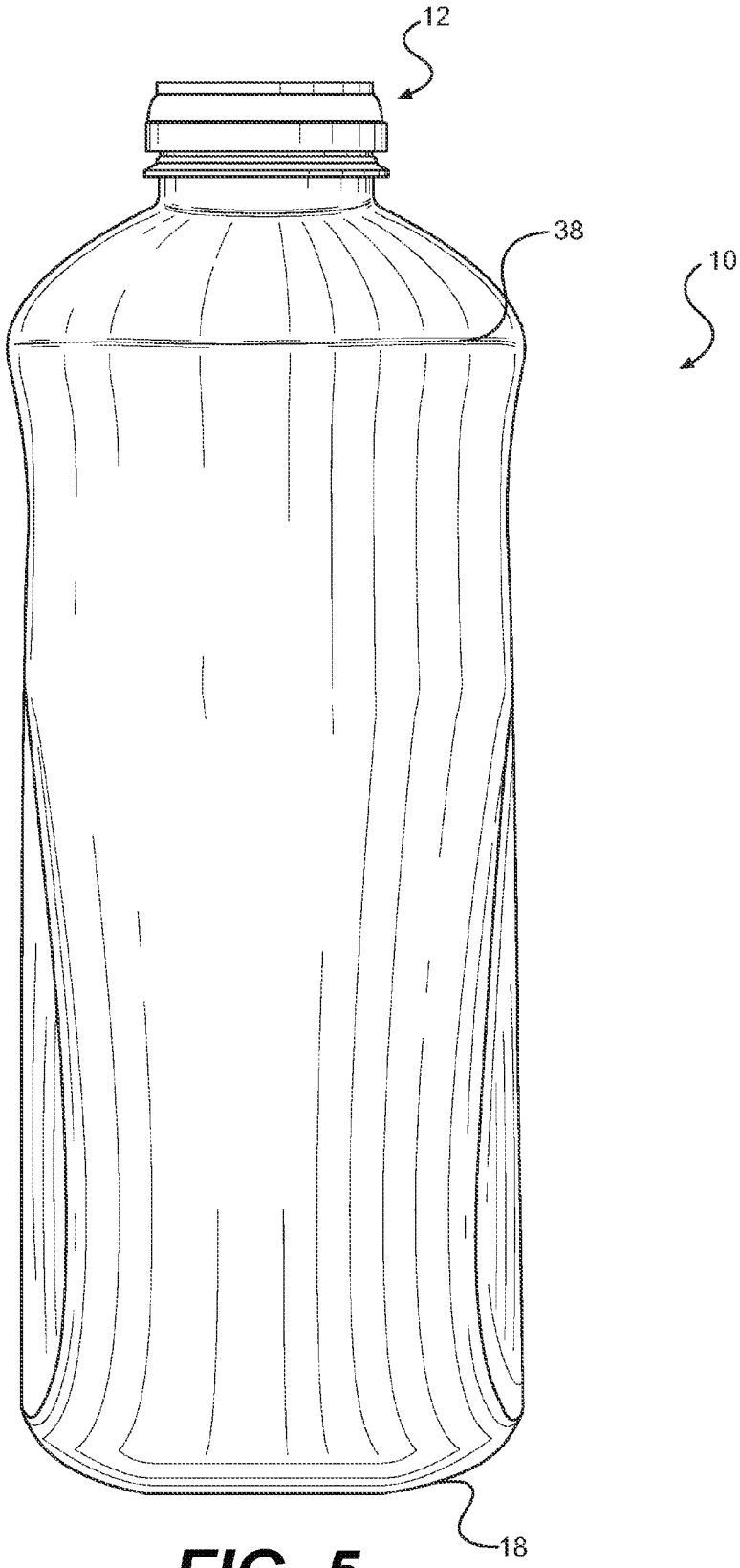
FIG. 5 is a second side elevational view of the plastic container that is depicted in FIG. 1.

Plastic container 10 further preferably includes a bottom portion 18 and a container body 20 that is unitary with both the upper portion 12 and the bottom portion 18. Container body 20 includes a side wall 22 that is configured so as to define an outer handle portion 24, a main body portion 26 and a recessed grip portion 28 as is best shown in FIGS. 1 and 2. As FIG. 3 clearly shows, the container 10 is non-round, having a substantially rectangular shape when viewed in transverse cross-section. As FIG. 2 clearly shows, the outer handle 24 has an outer surface 50 that is curved when viewed in front elevation, so as to form part of a side surface and part of a top surface of the main body portion 26.

In the preferred embodiment, the container body 20 includes a forward side 52 that is depicted in FIG. 2 and a rearward side 54 that is constructed so as to be substantially symmetrical to the forward side 52. In other words, the rearward side 54 also includes a side wall 22 that is configured so as to define an outer handle portion 24, a main body portion 26 and a recessed grip portion 28, and each of these features are constructed so as to be substantially the same size and the same proportion as their counterparts on the forward side 52 with the exception that that they are symmetrically opposed or mirror images.

A consumer is expected to grip the plastic container 10 by wrapping his or her palm around the outer handle portion 24 and pinching the container body 20 by applying pressure by the forefingers and the thumb in the area of the opposed recessed grip portions 28, and in particular in the uppermost areas of the recessed grip portions 28.

According to one particularly advantageous feature of the invention, a grip reinforcement rib 32 is integrated into at least one of the outer handle portion 24 and the main body portion 26 of both the forward side 52 and the rearward side 54 of the container body 20. One important purpose of the grip reinforcement rib 32 is to provide additional strength against inward compression of the container body 20 as a result of compressive forces that may be applied to the recessed grip portions 28 by a consumer during use. This will reduce the probability that gripping of the container 10 by the consumer will compress the container inwardly far enough to materially reduce the volume of the container 10 or to adversely affect the pouring characteristics of the container 10.

The grip reinforcement rib 32 according to the preferred embodiment of the invention includes a first portion 34 that is integrated within the outer handle portion 24 and a second portion 36 that extends continuously from the first portion 34, traversing an upper portion of the main body portion 26 of the container body 20, where it merges into a torsional reinforcement rib 38 that is provided on an upper side surface of the container 10 and that will be described in greater detail below.

As is best shown in FIG. 2, each of the opposing recessed grip portions 28 is teardrop-shaped and includes an outer border or contour 40 that has a first side portion 42 located along an outer interface between the respective grip portion 28 and the outer handle portion 24. The outer border or contour 40 further includes a second side portion 44 that is located at an interface between the respective grip portion 28 and the main body portion 26 of the container body 20. Additionally, the outer border or contour 40 further includes a curved upper portion 46 that is located at an interface between the grip portion 28 and a portion of the container body 20 where the outer handle portion 24 merges into the main body portion 26. No new matter has been added.

As may be seen in FIG. 2, the first portion 34 of the grip reinforcement rib 32 is positioned substantially adjacent to the recessed grip portion 28 and more specifically is contoured so as to substantially conform or possess congruence with respect to the first side portion 42 of the outer border or contour 40 of the recessed grip portion 28. This ensures that the strengthening effect that is provided by the first portion 34 of the grip reinforcement rib 32 is provided continuously along the outer contour of the recessed grip portion 28. The first portion 34 of the grip reinforcement rib 32 is unitary with and an integral portion of the sidewall that defines the shape of the outer handle portion 24.

It is expected that the pinching force that will be exerted by the consumer on the opposing recessed grip portions 28 will be concentrated in the upper areas of the recessed grip portions 28 near the respective upper boundaries 46. As FIG. 2 shows, both the first portion 34 and the second portion 36 of the grip reinforcement rib 32 have sections thereof that are located adjacent to the curved upper portion 46 of the outer border or contour 40 of the recessed grip portion 28. Accordingly, both the first portion 34 and the second portion 36 of the grip reinforcement rib 32 provide reinforcement of this critical area of the container body 20 against inward deflection that may be caused by the concentration of pinching force that is expected of consumers. In other words, both of the outer handle portion 24 and the main body portion 26 of the container body 20 have been reinforced and stabilized in order to assume the force concentration that is expected at or near the apex of the recessed grip portions 28.

Figure 7:
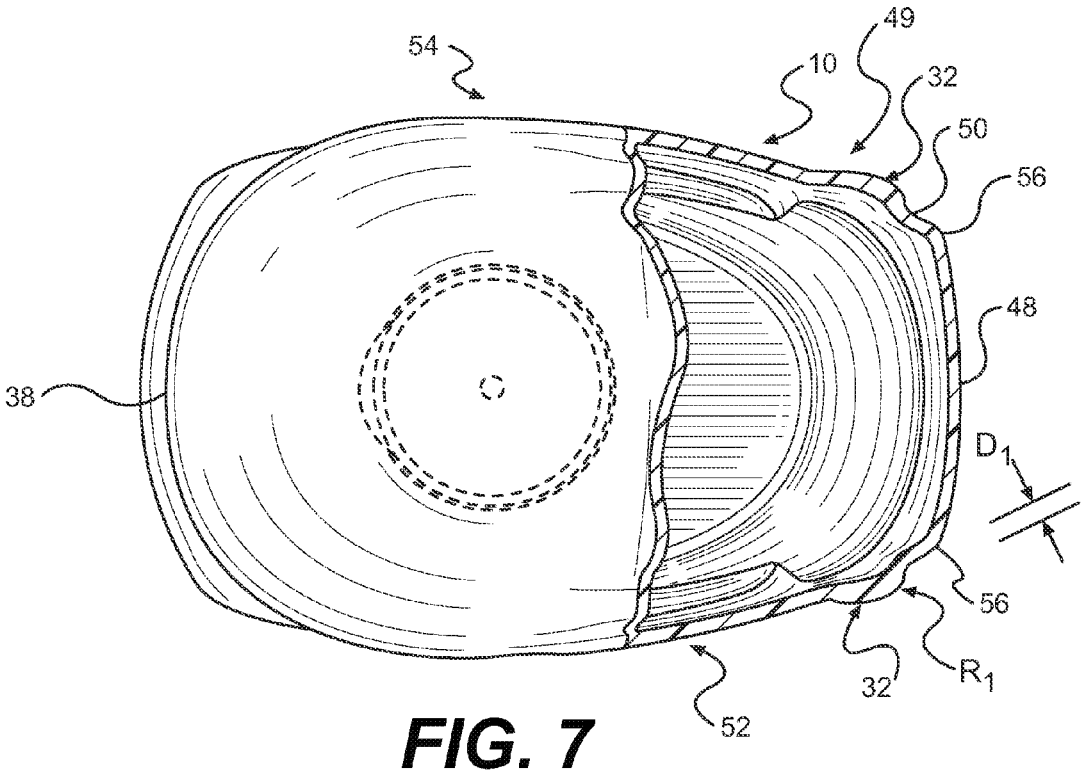
FIG. 7 is a cross-sectional view taken along lines 7-7 in FIG. 2.

Referring to FIG. 7, which is a transverse cross-sectional view taken along lines 7-7 in FIG. 2, it will be seen that the outer handle portion 24 includes an outermost surface 48 and a pair of side surfaces 49 into which the respective first portions 34 of the grip reinforcement ribs 32 have been integrated. Radiused transition portions or edges 56 are located at the respective boundaries between the outermost surface 48 and the side surfaces 49 of the outer handle portion 24. As FIG. 7 shows, the reinforcing rib 32 has an outer surface that is convex as viewed in transverse cross-section and that has a radius $R_1$ that is preferably within a range of about 0.125 inches to about 0.350 inches. In addition, the reinforcing rib 32 preferably extends outwardly from an adjacent portion of the sidewall by distance $D_1$ of at least 0.175 inches.

As may be seen in FIG. 7 and in FIG. 2, a curved channel 50 is defined in the side surfaces 49 of the outer handle portion 24 outwardly and congruent from the first portion 34 of the reinforcing rib 32.

Another important aspect of the invention involves the enhanced torsional resistance against deformation that is imparted by the presence of the torsional reinforcing rib 38 that has been briefly discussed above.

The torsional reinforcing rib 38 provides torsional reinforcement against inward deflection of the forward surface 52 and the rearward surface 54 of the container body 20 as a result of compressive forces that may be applied to the forward and rearward surfaces 52, 54 by a consumer. Accordingly, structural integrity of the container 10 is enhanced, particularly during pouring.

Figure 8:
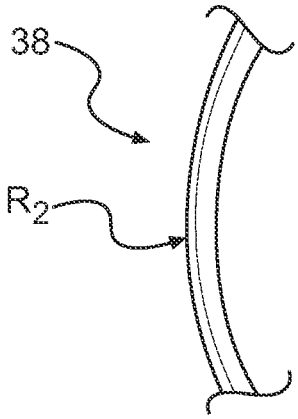
FIG. 8 is a cross-sectional view taken along lines 8-8 in FIG. 6.

When viewed a longitudinal cross-section as is shown in FIG. 8, an outer surface of the torsional reinforcing rib 38 is convexly curved, preferably at a substantially constant radius $R_2$ that is preferably within a range of about 0.15 inches to about 0.5 inches. In addition, the outermost portion of the reinforcing rib 38 preferably extends outwardly with respect to adjacent portions of the container sidewall by distance $D_2$ of at least 0.20 inches, as is depicted in FIG. 2. As the drawings show, the torsional reinforcing rib 38 preferably does not extend about an entire perimeter of the main body portion 26.

Figure 6:
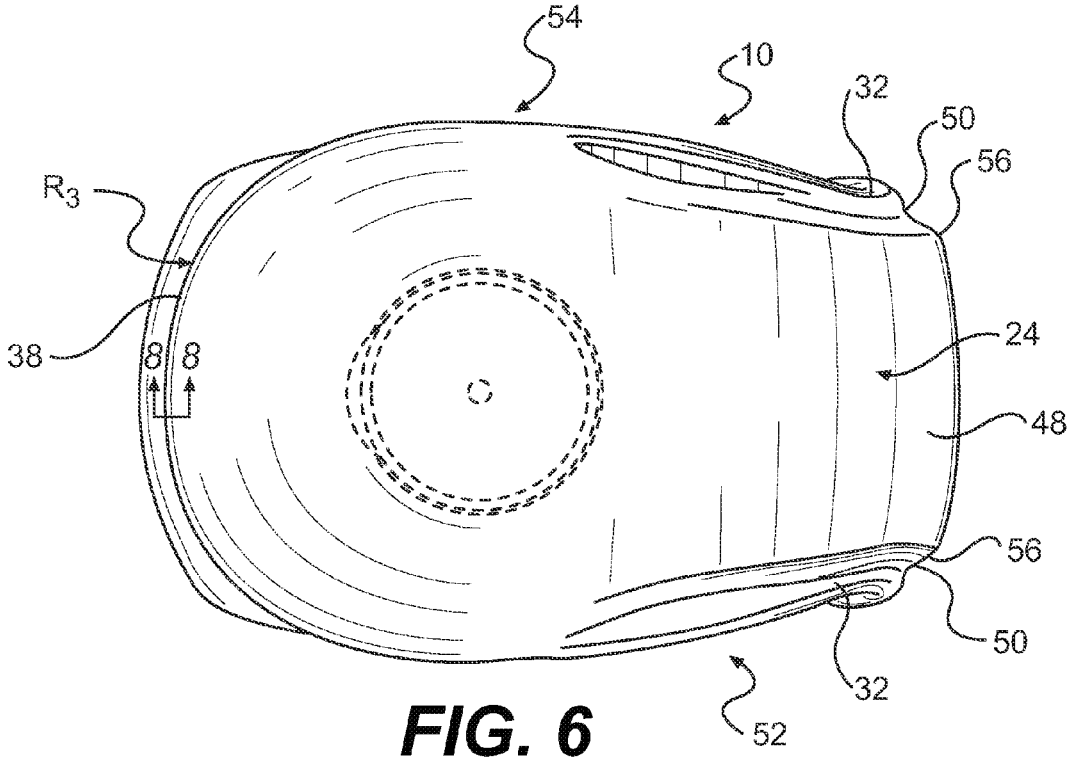
FIG. 6 is a top plan view of the plastic container that is depicted in FIG. 1.

When viewed in transverse cross-section or in top plan is shown in FIG. 6, the outer surface of the torsional reinforcing rib 38 is also convexly curved, preferably at a substantially constant radius $R_3$ that is preferably within a range of about 0.75 inches to about 4.0 inches. The outermost edge of the torsional reinforcing rib 38 preferably reside substantially within a plane that is substantially orthogonal to the longitudinal axis $A_1$ of the container 10.

The torsional reinforcing rib 38 is preferably integral with the respective second portions 36 of the grip reinforcing rib 32 that are defined in the main body portion 26 of the container body 20. This enhances the overall strength of the outer sidewall of the container 10 and the improved strength effect that is achieved by both the torsional reinforcing rib 38 in the respective grip reinforcing ribs 32.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A plastic container, comprising:

an upper portion having an opening defined therein;

a bottom portion;

a substantially rectangular container body having a side wall, said side wall being configured so as to define:

a curved outer handle portion having an outer surface that is curved when viewed in front elevation so as to form part of a side surface and part of a top surface of the container body;

a main body portion and a recessed grip portion having a side portion that is adapted to be pinched by a consumer during gripping positioned between said main body portion and said outer handle portion;

said container body further comprising at least one grip reinforcement rib that is integrated into at least one of said outer handle portion and said main body portion, said at least one grip reinforcement rib providing additional strength against inward compression of said container body as a result of compressive forces that may be applied to said side portion by a consumer and comprising a reinforcement rib that is positioned substantially adjacent to said recessed grip portion and integrated into the handle portion, and wherein a curved channel is defined between said reinforcement rib and said curved outer surface of said handle portion; and a torsional reinforcement rib that is integrated into an upper side portion of said container body, said torsional reinforcement rib being integral with said reinforcement rib so as to form a single continuous rib, thereby providing additional reinforcement against deflection as a result of pinching force applied by a consumer during gripping of the container.

2. A plastic container according to claim 1, wherein said reinforcement rib is contoured so as to substantially conform to a curved outer border of said recessed grip portion.

3. A plastic container according to claim 1, wherein said reinforcement rib further extends into said main body portion of said container body.

4. A plastic container according to claim 1, wherein said container body comprises a forward side and a rearward side, and wherein said forward and rearward sides are constructed and arranged to be substantially symmetrical, whereby at least one grip reinforcement rib is provided on both said forward side and said rearward side.

5. A plastic container according to claim 1, wherein said container is integrally molded and is fabricated from a material comprising polyolefin.

6. A plastic container according to claim 1, wherein said container is integrally molded and is fabricated from the material comprising polyethylene terephthalate.

7. A plastic container according to claim 1, wherein said reinforcing rib has an outer surface that is convex as viewed in transverse cross-section.

8. A plastic container according to claim 7, wherein at least a portion of said outer surface of said reinforcing rib is curved at a radius that is within a range of about 0.125 inches to about 0.350 inches.

9. A plastic container according to claim 7, wherein said reinforcing rib extends outwardly from an adjacent portion of said sidewall by a distance of at least about 0.175 inches.

10. A plastic container, comprising:

an upper portion having an opening defined therein;

a bottom portion;

a non-round container body having a side wall, said side wall being configured so as to define a main body portion having a curved outer handle portion forming part of a side surface and part of a top surface of the main body portion, and a recessed grip portion positioned between said main body portion and said curved outer handle portion, said container body further comprising at least one curved grip reinforcement rib that is integrated into the outer handle portion, the at least one grip reinforcement rib providing additional strength against inward compression of said container body as a result of compressive forces that may be applied to said recessed grip portion by a consumer; and a curved channel defined in the outer handle portion, the curved channel being substantially congruent with the curved grip reinforcement rib.

11. A plastic container according to claim 10, wherein the recessed grip portion includes a first, outer side portion adjacent to the outer handle portion, a second, inner side portion and a curved apex portion, and wherein the grip reinforcement rib is positioned adjacent to the curved apex portion for reinforcing the curved apex portion.

12. A plastic container according to claim 11, wherein the first, outer side portion is curved.

13. A plastic container according to claim 11, wherein the second, inner side portion is curved.

14. A plastic container, comprising:

an upper portion having an opening defined therein;

a bottom portion;

a non-round container body having a side wall, said side wall being configured so as to define an outer handle portion, a main body portion and a recessed teardrop-shaped grip portion positioned between said main body portion and the outer handle portion, the recessed grip portion including a side portion that is adapted to be pinched by a consumer during gripping, the side portion including a first, outer side portion adjacent to the outer handle portion, a second, inner side portion and a curved apex portion;

a reinforcement rib positioned adjacent to the curved apex portion for reinforcing the curved apex portion; and further comprising a channel defined in the sidewall adjacent to the reinforcement rib.

15. A plastic container according to claim 14, wherein the first, outer side portion is curved.

16. A plastic container according to claim 14, wherein the second, inner side portion is curved.

17. A plastic container according to claim 14, wherein the reinforcement rib includes a first portion positioned on the outer handle portion and a second portion that is positioned on the main body portion.

18. A plastic container according to claim 14, wherein the reinforcement rib includes a convex outer surface when viewed in transverse cross-section.

19. A plastic container according to claim 18, wherein the convex outer surface has a radius that is within a range of about 0.125 inches to about 0.350 inches.

20. A plastic container according to claim 14, wherein the reinforcing rib 32 extends outwardly from an adjacent portion of the sidewall by a distance of at least 0.175 inches.

21. A plastic container according to claim 3, wherein said container body comprises a forward side and a rearward side, and wherein said forward and rearward sides are constructed and arranged to be substantially symmetrical.

22. A plastic container, comprising:

an upper portion having an opening defined therein;

a bottom portion; and a substantially rectangular container body having a side wall, said side wall being configured so as to define a curved outer handle portion having an outer surface that is curved when viewed in front elevation so as to form part of a side surface and part of a top surface of the container body, a main body portion and a recessed grip portion positioned between said main body portion and said outer handle portion, said container body further comprising at least one grip reinforcement rib that is integrated into the outer handle portion and is positioned substantially adjacent to said recessed grip portion, said at least one grip reinforcement rib providing additional strength against inward compression of said container body as a result of compressive forces that may be applied to said recessed grip portion by a consumer, and wherein a curved channel is defined between said reinforcement rib and said curved outer surface of said handle portion.

* * * * *